US011496844B2

(12) United States Patent
Zhang

(10) Patent No.: US 11,496,844 B2
(45) Date of Patent: Nov. 8, 2022

(54) COMPLETELY-IN-CANAL HEARING AID

(71) Applicant: Xiamen Retone Hearing Technology Co., Ltd., Xiamen (CN)

(72) Inventor: Chengxiang Zhang, Xiamen (CN)

(73) Assignee: Xiamen Retone Hearing Technology Co., Ltd., Xiamen (CN)

( * ) Notice: Subject to any disclaimer, the term of this patent is extended or adjusted under 35 U.S.C. 154(b) by 0 days.

(21) Appl. No.: 17/337,460

(22) Filed: Jun. 3, 2021

(65) Prior Publication Data

US 2022/0303696 A1 Sep. 22, 2022

(30) Foreign Application Priority Data

Mar. 19, 2021 (CN) ..... 202110305650.7

(51) Int. Cl.
*H04R 1/00* (2006.01)
*H04R 25/00* (2006.01)

(52) U.S. Cl.
CPC ..... *H04R 25/60* (2013.01); *H04R 25/652* (2013.01); *H04R 2225/023* (2013.01)

(58) Field of Classification Search
CPC ..... H04R 25/02; H04R 25/656; H04R 2225/023; H04R 2460/17; H04R 25/556; H04R 25/558; H04R 1/1041; H04R 1/1016
See application file for complete search history.

(56) References Cited

U.S. PATENT DOCUMENTS 7,010,137 B1 * 3/2006 Leedom ..... H04R 25/456 381/328

FOREIGN PATENT DOCUMENTS

CN 203167211 U 8/2013
CN 205622877 U 10/2016

* cited by examiner

*Primary Examiner* — Amir H Etesam
(74) *Attorney, Agent, or Firm* — Bayramoglu Law Offices LLC

(57) ABSTRACT

A completely-in-canal hearing aid, including a housing, a receiver, a chip, a battery, a flexible circuit board and a microphone, wherein the housing includes a front section and a rear section; the receiver and the chip are located in the front section; the battery is located in the rear section; the rear section has two opposite surfaces and two opposite side surfaces; the front section has a first central axis parallel to the length of the front section; the rear section has a second central axis located between the two opposite surfaces and between the two opposite side surfaces; the first central axis and the second central axis are different straight lines. The completely-in-canal hearing aid is fine and compact in structure, reasonable and ingenious in design, diversified in function and comfortable to wear.

9 Claims, 11 Drawing Sheets

COMPLETELY-IN-CANAL HEARING AID

CROSS REFERENCE TO THE RELATED APPLICATIONS

This application is based upon and claims priority to Chinese Patent Application No. 202110305650.7, filed on Mar. 19, 2021, the entire contents of which are incorporated herein by reference.

TECHNICAL FIELD

The present disclosure relates to the field of hearing aids, in particular to a completely-in-canal hearing aid.

BACKGROUND

A hearing aid is usually installed in or behind an ear of a user to amplify the sound for the user. Some common types of hearing aids include behind-the-ear (BTE) hearing aids, in-the-ear (ITE) hearing aids, in-the-canal (ITC) hearing aids, completely-in-canal (CIC) hearing aids, etc.

A CIC hearing aid has the advantages of small size and strong concealment. It does not require an external circuit wire or a microphone tube, so it can meet aesthetic and psychological needs of the deaf.

For more information about existing hearing aids, see the Chinese patents with the announcement No. CN205622877U and CN203167211U.

SUMMARY

The present disclosure provides a new completely-in-canal hearing aid for further improving the hearing aids.

The present disclosure is implemented as follows: it provides a completely-in-canal hearing aid, including a housing, a receiver, a chip, a battery, a flexible circuit board and a microphone; the housing includes a front section and a rear section; the receiver and the chip are located in the front section; the battery is located in the rear section; the rear section has two opposite surfaces and two opposite side surfaces; the front section has a first central axis parallel to the length thereof; the rear section has a second central axis located between the two opposite surfaces and between the two opposite side surfaces; the first central axis and the second central axis are different straight lines.

The two opposite surfaces of the rear section are planes; the housing is divided into a first housing body and a second housing body, wherein the first housing body and the second housing body each have an opposite side surface, the opposite side surface of the first housing body is a first side surface, the opposite side surface of the second housing body is a second side surface, the first side surface is shown as a part of a cylindrical side surface, and the second side surface is shown as another part of the cylindrical side surface; the first housing body includes a first front section and a first rear section connected to each other; the second housing body includes a second front section and a second rear section connected to each other; the receiver and the chip are located in the first front section and the second front section; and the battery is located in the first rear section and the second rear section.

The battery can be a button battery; the flexible circuit board has an annular portion bent into an annular shape, which surrounds the peripheral side of the battery.

The hearing aid provided by the present disclosure:

A housing is designed to have a front section and a rear section, so that the receiver and the chip are located in the front section, and the battery is located in the rear section; and the rear section is then designed to have corresponding two opposite planes and two opposite side surfaces, and the first central axis of the front section and the second central axis of the rear section are designed to be different straight lines, so that the completely-in-canal hearing aid is fine and compact in structure, reasonable and ingenious in design, diversified in function and comfortable to wear.

The first surface, the second surface, the first side surface and the second side surface of the rear section define the rear section with a relatively regular flat structure, and the appearance of the rear section is roughly similar to that of the battery, that is, the design of the two opposite surfaces and the two opposite side surfaces of the rear section causes the battery to be tightly located in the rear section to reduce the width and size of the hearing aid.

An included angle, between a first plane bisecting the width of the front section and bisecting a front opening and a second plane bisecting the width of the rear section and bisecting a rear opening, is 5-30 degrees. The included angle range will be beneficial to the use of human ears, and is also beneficial to the reduction of the length. At the same time, the angle range is ergonomically satisfying. An included angle, between a third plane bisecting the thickness of the front section and a fourth plane bisecting the thickness of the rear section, is 1-20 degrees. The included angle range will be beneficial to the use of human ears, and is also beneficial to the reduction of the length. At the same time, the angle range is ergonomically satisfying. At the same time, the above two included angles coordinate and cooperate with each other, jointly defining the angle relationship between the front section and the rear section, which makes the entire hearing aid structure coordinated. In this way, an angle range combined with the shape of the housing makes the overall design exquisite, makes the hearing aid comfortable to wear and easy to take out, achieves good use performance, and ensures that the hearing aid has a small size.

DETAILED DESCRIPTION OF THE EMBODIMENTS

The embodiments described below with reference to the drawings are illustrative, intended to explain the present disclosure rather than a limitation.

The present disclosure of this embodiment provides a completely-in-canal hearing aid. A hearing aid generally includes a left ear hearing aid and a right ear hearing aid which are symmetrical. This embodiment only describes the left ear hearing aid. Since the right ear hearing aid is symmetrical to the left ear hearing aid in structure, the right ear hearing aid falls within the protection scope of the present disclosure too.

The hearing aid of this embodiment includes a flexible circuit board, an electrical contact structure and a microphone structure. Therefore, this embodiment also provides a flexible circuit board of the hearing aid, a hearing aid electrical contact structure and a hearing aid microphone structure.

Figure 1:
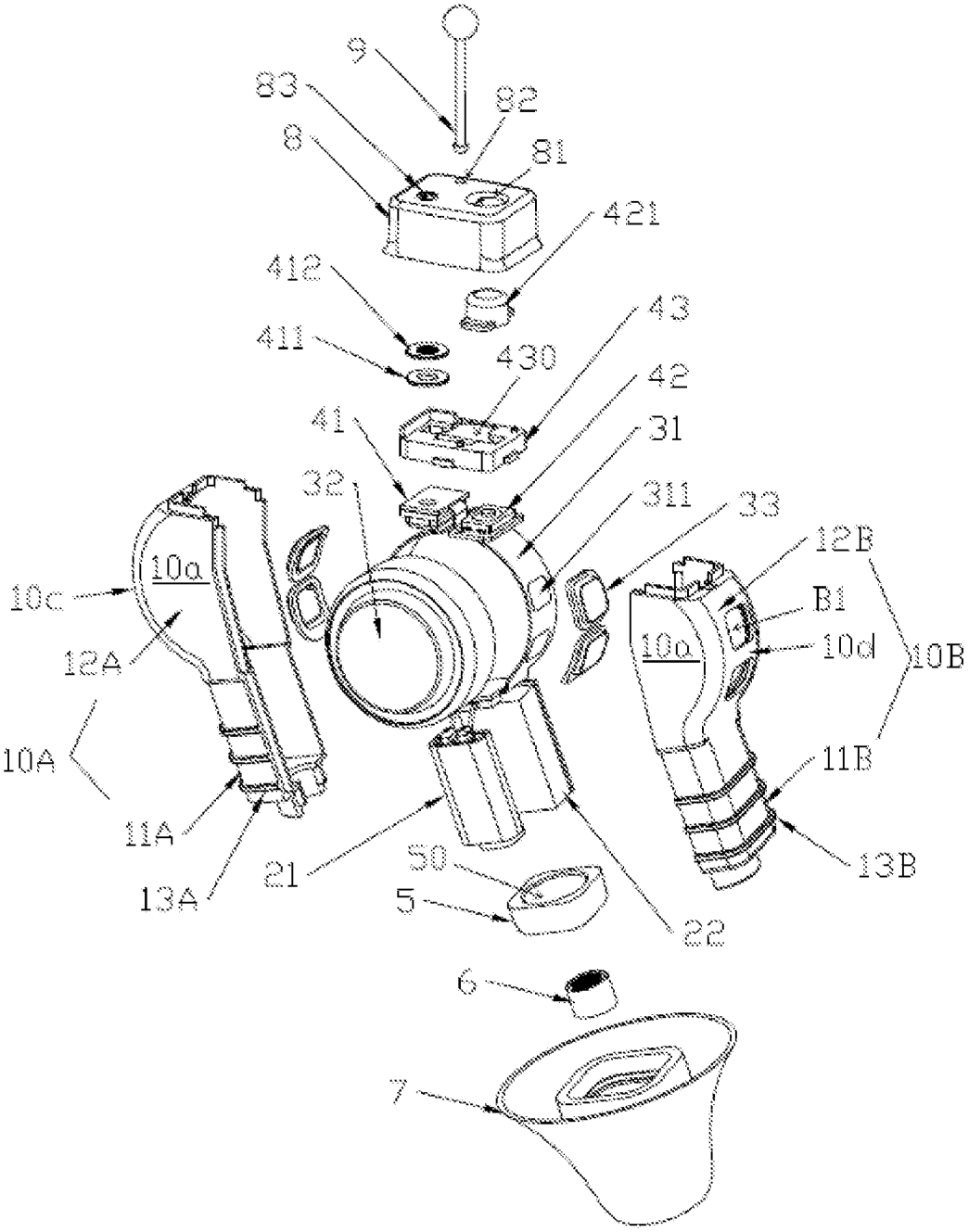
FIG. 1 is an exploded diagram of a hearing aid.

The exploded view of FIG. 1 shows that the hearing aid includes a housing 10 (10 is marked in FIGS. 6 and 7), a receiver 21, a chip 22, a flexible circuit board 31, a battery 32, a conductive contact sheet 33, a microphone 41, a switch 42, a bracket 43, a front cover 5, a cerumen cap 6, an earplug 7, a rear cover 8 and a take-out line 9. The flexible circuit board 31 includes pads 311. Sound-guiding foam 411 and a dust-proof net 412 also cooperate with the microphone 41. A button 421 also cooperates with the switch 42. The front cover 5 has a front through hole 50, and the rear cover 8 has a button hole 81, a wire hole 82 and a sound receiving port 83.

In other embodiments, there may be no button, and in this case, the rear cover may not have a button hole. In this structure, the user can switch the hearing aid's program by tapping the hearing aid while wearing it. The program switching principle of this hearing aid is that the corresponding chip can detect the airflow through the microphone, and directly perform the program switching operation by sensing the change of the airflow.

Figure 6:
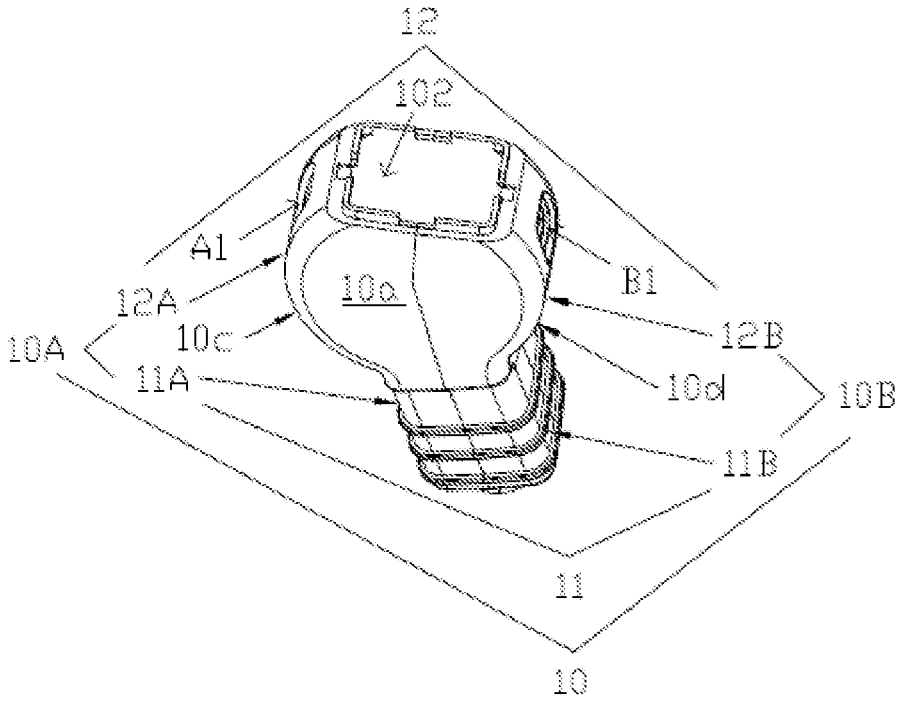
FIG. 6 is a schematic diagram of a housing from a first viewing angle.
Figure 7:
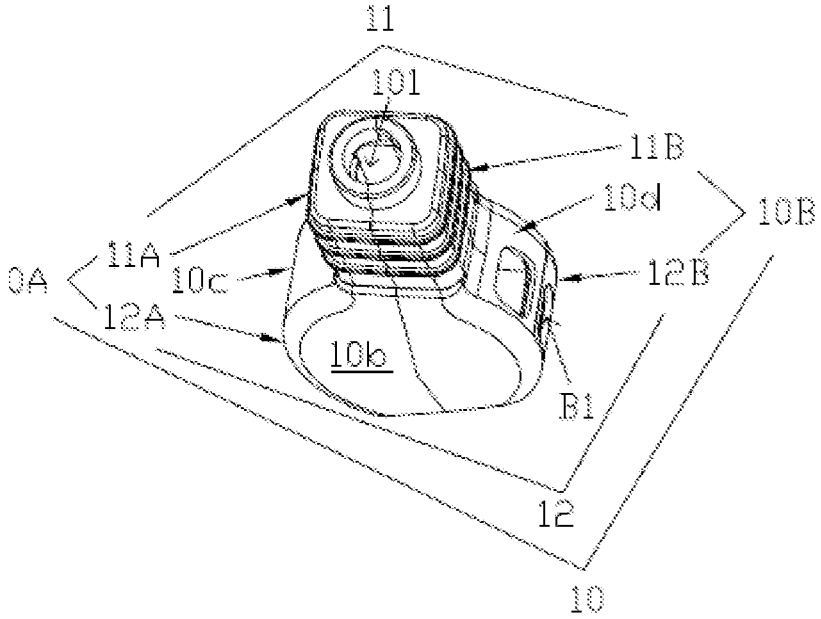
FIG. 7 is a schematic diagram of the housing from a second viewing angle.

In this embodiment, the housing 10 is divided into a front section 11 and a rear section 12, and also into a first housing body 10A and a second housing body 10B. Referring to FIG. 1, the housing 10 is divided into the first housing body 10A and the second housing body 10B, wherein the first housing body 10A includes a first front section 11A and a first rear section 12A connected to each other, and the second housing body 10B includes a second front section 11B and a second rear section 12B connected to each other. Referring to FIGS. 6 and 7, the housing 10 includes the front section 11 and the rear section 12, wherein the front section 11 includes the first front section 11A and the second front section 11B, and the rear section 12 includes the first rear section 12A and the second rear section 12B.

Figure 2:
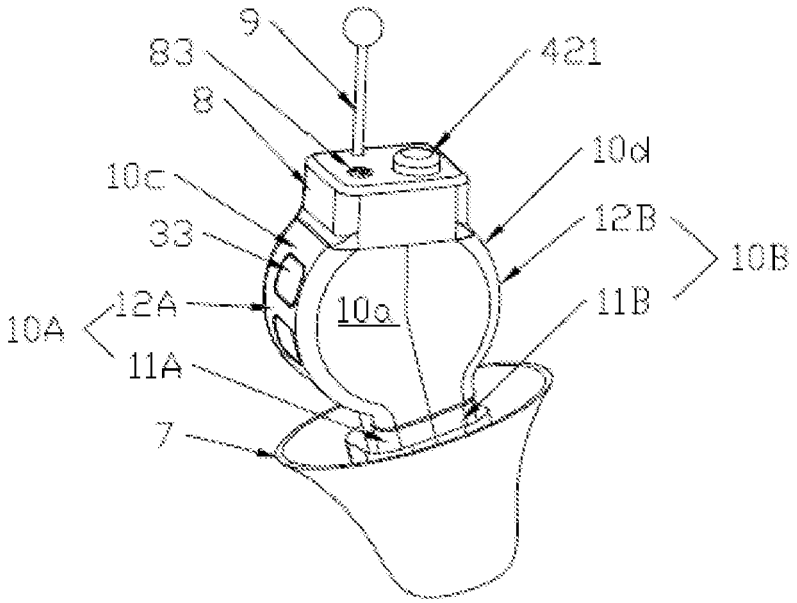
FIG. 2 is a schematic diagram of the hearing aid from a first viewing angle.
Figure 3:
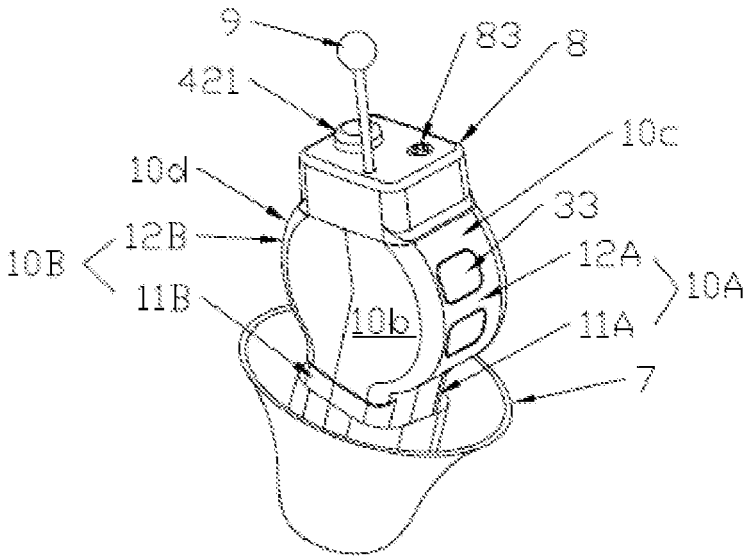
FIG. 3 is a schematic diagram of the hearing aid from a second viewing angle.

Referring to FIGS. 2 and 3, the overall appearance of the hearing aid is shown in FIGS. 2 and 3. At this time, the first housing body 10A and the second housing body 10B are assembled together. In FIGS. 2 and 3, the lower end of the structure corresponds to the front end of the hearing aid, and the upper end of the structure corresponds to the rear end of the hearing aid. It can be seen from FIGS. 1 to 5 that the front cover 5 is set at the front end of the first front section 11A and the second front section 11B, and the earplug 7 is assembled at the front end of the hearing aid through the front cover 5, that is, the earplug 7 is assembled at the front end of the housing 10, that is, the earplug 7 is set at the front end of the first front section 11A and the second front section 11B. Further, the earplug 7 is assembled at the front end of the first front section and the second front section through the front cover 5, and the earplug 7 is specifically assembled at the front end of the first front section 11A and the second front section 11B through the front cover 5, and the earplug 7 is connected and fixed to the front end of the first front section 11A and the second front section 11B through the front cover 5.

The earplug 7 used in this embodiment is a horn-shaped earplug. In other embodiments, the earplug may be in other shapes.

Referring back to FIG. 1, an outer surface of the first front section 11A has a first outer convex edge 13A, and an outer surface of the second front section 11B has a second outer convex edge 13B. The first outer convex edge 13A and the second outer convex edge 13B are used for fitting the assembly of the earplug 7 so that the earplug 7 is not easy to fall off.

Referring to FIG. 6, the rear section 12 has a rear opening 102. Referring to FIG. 7, the front section 11 has a front opening 101.

It can be seen from FIGS. 1 to 5 that the cerumen cap 6 is installed between the front opening 101 and the front end of the first front section 11A and the second front section 11B, that is, installed between the front cover 5 and the front end of the housing 10. In addition, it can be seen from FIGS. 1 to 9 that the cerumen cap 6 is arranged in the front through hole 50 of the front cover 5.

FIGS. 2 and 3 also show that when the earplug 7 is horn-shaped, the widest part of the entire hearing aid is only the diameter of the horn edge of the earplug 7. The width of the housing 10 is smaller than the diameter of the horn edge, and the thickness of the housing 10 is smaller, so that the hearing aid has a small structure, the entire hearing aid can basically enter the user's ear canal, and the hearing aid is a completely-in-canal hearing aid.

Figure 4:
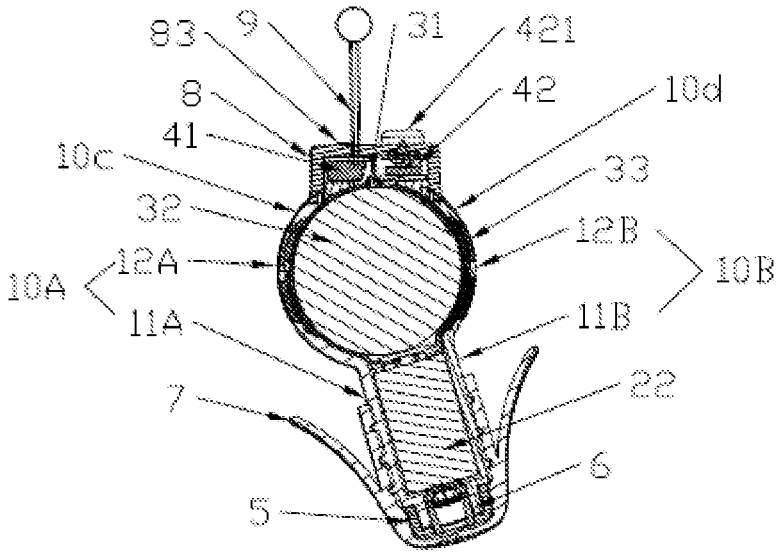
FIG. 4 is a schematic diagram of a first cross-sectional structure of the hearing aid.
Figure 5:
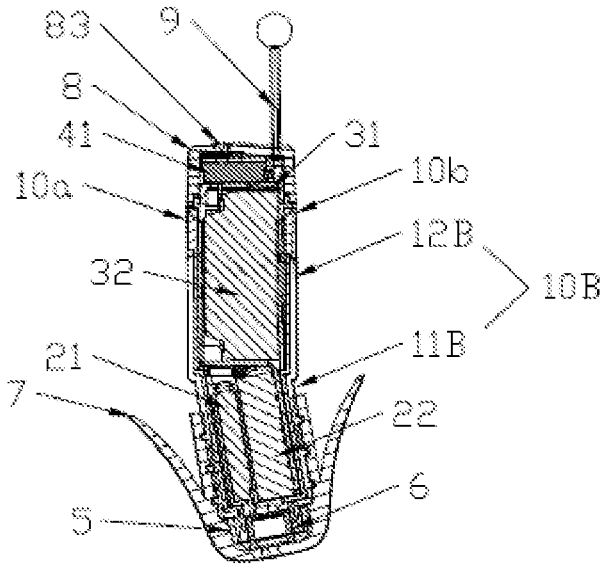
FIG. 5 is a schematic diagram of a second cross-sectional structure of the hearing aid.

FIGS. 4 and 5 show the cross-sectional structure of the hearing aid from two different viewing angles, wherein FIG. 4 is a cross section obtained by cutting a plane parallel to the length and width of the hearing aid, and FIG. 5 is a cross section obtained by cutting a plane parallel to the thickness and length of the hearing aid. It can be seen from the two cross-sectional views that the hearing aid is compact, so that the size can be small.

FIGS. 4 and 5 also show that the flexible circuit board 31 is on the peripheral side of the battery 32. FIG. 4 shows that the battery 32 inside the housing 10 is the structure with the largest width. Therefore, the width of the housing 10 only needs to be slightly larger than the battery 32, which again proves that the entire hearing aid is small in width and size.

Referring to FIGS. 1 to 5, the receiver 21 and the chip 22 are located in the front section 11 of the housing 10, which helps to reduce the size of the hearing aid and also ensures that a user can get a greater sound output and the whole structure is solid and durable. Referring to FIGS. 1 to 5, the battery 32 is located in the rear section 12 of the housing 10, and a large portion of the rear section 12 is similar in appearance to the battery 32 with reference to FIG. 4, which again helps to reduce the size of the hearing aid. The design and coordination of these two internal structures can save space and reduce size.

Referring to FIGS. 1 to 9, the appearance of the front section 11 is basically a chamfered cuboid, the chip 22 is a cuboid, and the receiver 21 is also roughly a cuboid. The chip 22 is arranged on a part of the flexible circuit board 31, and specifically arranged on a chip portion 314, with reference to subsequent FIGS. 10 and 11; the receiver 21 is electrically connected to the flexible circuit board 31 through a corresponding wire (not marked), and specifically electrically connected to a device portion 313, with reference to subsequent FIGS. 10 and 11. At the same time, the receiver 21 and the chip 22 are stacked side by side, and the length direction of the receiver 21 and the chip 22 are both consistent with the length direction of the front section 11. This structure enables the receiver 21 and the chip 22 to be neatly arranged in the front section 11, which helps reduce the size even more.

Figure 8:
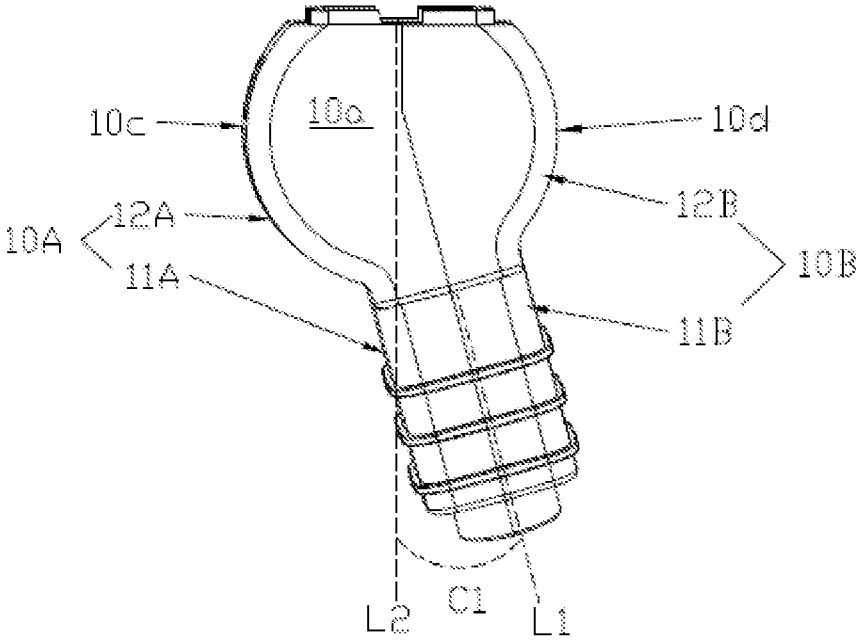
FIG. 8 is a schematic diagram of the housing from a third viewing angle.

Referring to FIGS. 1 to 9, the two opposite surfaces (i.e., the first surface 10*a* and the second surface 10*b*) of the rear section 12 are planes. In FIG. 1, the first surface 10*a* is divided into two parts, and FIGS. 2, 6 and 8 show that the two parts are joined together.

Referring to FIGS. 1 to 9, the rear section 12 has two substantially symmetrical opposite side surfaces, and the two opposite side surfaces are a first side surface 10*c* and a second side surface 10*d*, respectively. That is to say, the first housing body 10A and the second housing body 10B each have an opposite side surface, the first housing body 10A has the first side surface 10*c*, and the second housing body 10B has the second side surface 10*d*.

The first side surface 10*c* is shown as a part of a basically cylindrical side surface, and the second side surface 10*d* is shown as another part of the basically cylindrical side surface. The two side surfaces are basically symmetrical. However, the first side surface 10*c* may be slightly larger than the second side surface 10*d* (not affecting the basic symmetry of them), and the length of the first side surface 10*c* is slightly longer than the length of the second side surface 10*d*, as shown in FIG. 8. The length difference is usually on the order of millimeters, and for example, the length difference may be 2.59 mm, without affecting the basic symmetry of the two side surfaces.

In summary, in one aspect, the front section 11 has a cuboid hollow cylindrical structure as a whole, and the receiver 21 and the chip 22 are tightly arranged in the front section 11; in another aspect, the first surface 10*a*, the second surface 10*b*, the first side surface 10*c* and the second side surface 10*d* of the rear section 12 define a relatively regular flat structure, and the appearance of the rear section 12 is roughly similar to that of the battery 32, that is, the design of the two opposite surfaces and the two opposite side surfaces of the rear section 12 causes the battery 32 to be tightly located in the rear section 12 to reduce the width and size of the hearing aid. Therefore, both aspects help to reduce the size of the hearing aid.

In this embodiment, the front section 11 has a first central axis parallel to the length thereof. The rear section 12 has a second central axis located between the two opposite surfaces (the first surface 10*a* and the second surface 10*b*) and between the two opposite side surfaces (the first side surface 10*c* and the second side surface 10*d*). The first central axis and the second central axis are different straight lines, that is, there will be an included angle greater than zero between the two central axes.

In FIG. 8, the first central axis of the front section 11 is embodied as dashed line L1, and the second central axis of the rear section 12 is embodied as dashed line L2, and the two lines are different straight lines.

Figure 9:
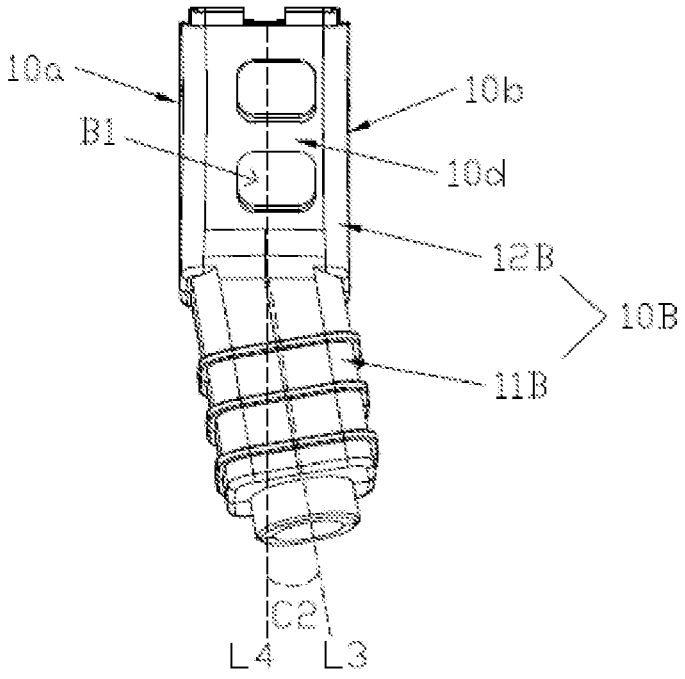
FIG. 9 is a schematic diagram of the housing from a fourth viewing angle.

In FIG. 9, the first central axis of the front section 11 is embodied as dashed line L3, and the second central axis of the rear section 12 is embodied as dashed line L4, indicating again that the two lines are different straight lines.

In this embodiment, the first central axis of the front section 11 and the second central axis of the rear section 12 are designed to be different straight lines, so that the appearance of the hearing aid is more ergonomic, and at the same time, it is beneficial to reduce the size.

In FIG. 8, an included angle between dashed line L1 and dashed line L2 is the included angle between the aforementioned two central axes at the viewing angle shown in FIG. 8. This included angle is also an included angle between a first plane (not marked) and a second plane (not marked). A plane bisecting the width of the front section 11 and bisecting the front opening 101 is the first plane (that is, the first plane can be represented by dashed line L1 in FIG. 8), and a plane bisecting the width of the rear section 12 and bisecting the rear opening 102 is the second plane (that is, the second plane can be represented by dashed line L2 in FIG. 8).

In this embodiment, the included angle C1 between the first plane and the second plane is designed to be 5-30 degrees. If the included angle C1 is larger than this angle range, it will not be beneficial to the use of human ears, and if the included angle C1 is smaller than this angle range, it will not be beneficial to the reduction of the length. At the same time, this angle range is ergonomic.

In FIG. 9, an included angle between dashed line L3 and dashed line L4 is the included angle between the aforementioned two central axes at the viewing angle shown in FIG. 9. This included angle is also an included angle between a third plane (not marked) and a fourth plane (not marked). A plane bisecting the thickness of the front section 11 is the third plane (that is, the third plane can be represented by dashed line L3 in FIG. 9), and a plane bisecting the thickness of the rear section 12 is the fourth plane (that is, the fourth plane can be represented by dashed line L4 in FIG. 9).

In this embodiment, the included angle C2 between the third plane and the fourth plane is designed to be 1-20 degrees. If the included angle C2 is larger than this angle range, it will not be beneficial to the use of human ears, and if the included angle C2 is smaller than this angle range, it will not be beneficial to the reduction of the length. At the same time, this angle range is ergonomic.

In addition, the included angle C1 and the included angle C2 coordinate and cooperate with each other, jointly define the angle relationship between the front section 11 and the rear section 12, make the entire hearing aid structure coordinated, and make the overall shape of the housing 10 resemble the Arabic numeral 6. Such an angle range combined with the shape of the housing makes the overall design exquisite, makes the hearing aid comfortable to wear and easy to take out, achieves good use performance, and ensures that the hearing aid has a small size.

Figure 11:
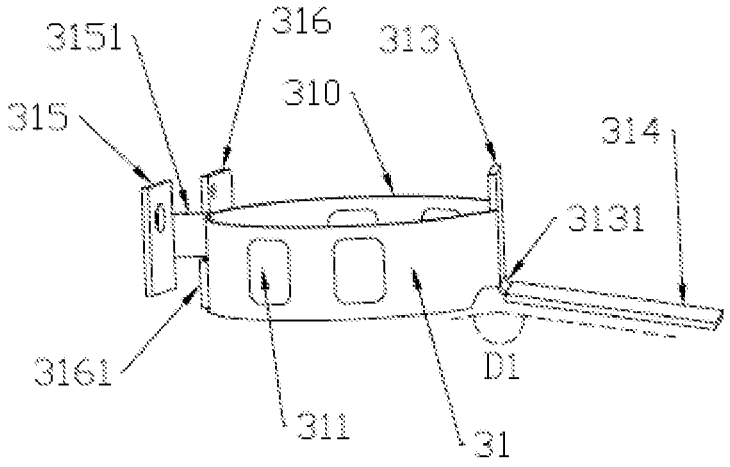
FIG. 11 is a schematic diagram of the flexible circuit board from a second viewing angle.
Figure 12:
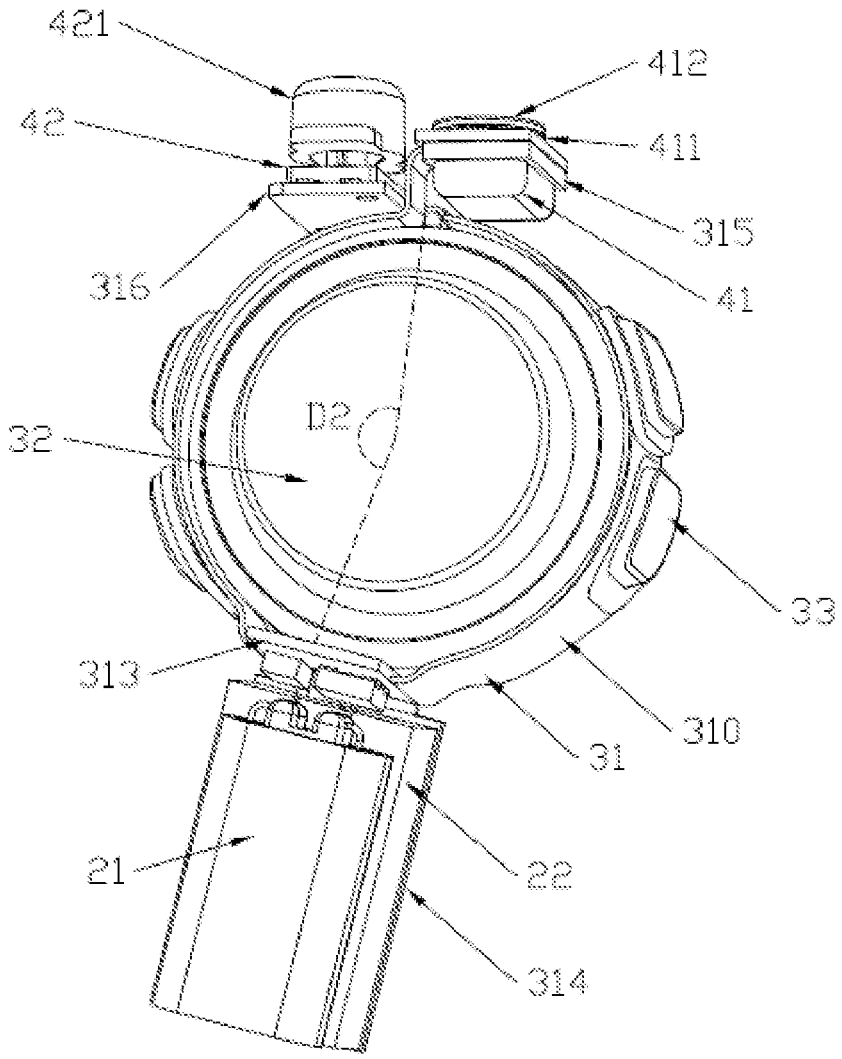
FIG. 12 is a schematic diagram of assembly of a corresponding structure of the flexible circuit board.

In this embodiment, the battery 32 is a button battery and is rechargeable. In this embodiment, the battery 32 is an important factor influencing the shape of the rear section 12 because the inside of the rear section 12 is mainly used for accommodating the battery 32. In this embodiment, the main body of the flexible circuit board 31 is bent into an annular portion 310 (referring to subsequent FIGS. 10 and 11), as shown in FIGS. 4, 5 and 12, specifically the annular portion 310 of the flexible circuit board 31 surrounds the peripheral side of the battery 32, and this is also related to the fact that the battery 32 is a button battery. Specifically, the flexible circuit board 31 may be pasted on the peripheral side of the battery 32 by using double-sided tape (not shown).

In this embodiment, an outer side surface of the first rear section 12A and an outer side surface of the second rear section 12B respectively have side holes, the first rear section 12A has two first side holes A1, and the second rear section 12B has two second side holes Bl. A conductive contact sheet 33 is assembled in each of these side holes. Four conductive contact sheets 33 are respectively electrically connected to four pads 311 on the outer side surface of the flexible circuit board 31, and reference may be made to FIGS. 1 and 4. The four conductive contact sheets 33 enable the hearing aid of this embodiment to have diversified functions, that is, the functions are more powerful, which can meet more usage needs of a user, and reference may be made to the subsequent contents.

Referring to FIGS. 1, 4 and 5, the bracket 43 is used for fixing a cross position of the flexible circuit board 31, and the bracket 43 is also used for fixing the switch 42 and the microphone 41 at the same time. Reference may also be made to subsequent FIG. 20. The bracket 43 cooperates with the rear cover 8 to protect the conductive foam 411 and the dust-proof net 412 that cooperate with the microphone 41. Reference may be made to FIGS. 18-21.

Referring to FIGS. 1 and 4, the rear end of the hearing aid is the rear cover 8, and the rear end of the housing 10 is sealed by the rear cover 8. One end of the button 421 is exposed outside the rear cover 8, and the other end is located in the rear cover 8 and abuts on the switch 42, so that the user can control the switch 42 through the button 421.

Referring to FIGS. 1 and 4, the take-out line 9 is installed at the rear cover 8, that is, the rear cover 8 and the take-out line 9 are assembled together. In addition, the main part of the take-out line 9 is exposed on the rear cover 8. The take-out line 9 has a larger end than the wire body (not distinctively marked), and the take-out line 9 is used for facilitating the take-out of the hearing aid.

Referring to FIGS. 1 to 9, the rear cover 8 of this embodiment is small in size, and the width of the rear cover 8 is smaller than the width of the rear section 12, resulting in a reduced size of the hearing aid, i.e., further ensuring a smaller size of the hearing aid.

The rear section 12 of the housing 10 has a rear opening 102 (as shown in FIG. 6), and the rear cover 8 covers the rear opening 102. At this point, the rear section 12 is like a flat cylindrical structure with two arcuate parts (not shown) cut off. The position where the larger arcuate part is cut off is the position of the rear opening 102, and the position where the smaller arcuate part is cut off is the connection position with the front section 11. The position where the larger arcuate part is cut off is not flat, but there is a part protruding backwards (not marked). As shown in FIGS. 6, 8 and 9, this protrusion becomes a part of the edge of the rear opening 102.

As mentioned above, this embodiment also provides a flexible circuit board 31.

Figure 10:
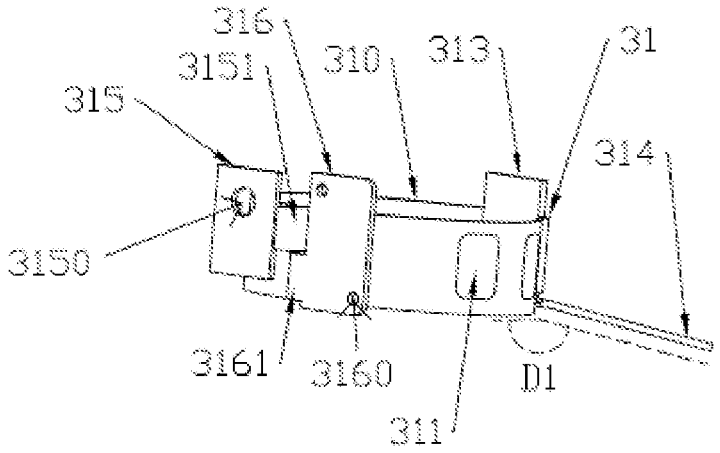
FIG. 10 is a schematic diagram of a flexible circuit board from a first viewing angle.

The flexible circuit board 31 has an annular portion 310 bent into an annular shape, and the annular portion 310 is used for surrounding the peripheral side of the battery 32. The outer surface of the annular portion 310 has a pad 311, and the pad 311 is used for electrically connecting the conductive contact sheet 33. FIGS. 10 and 11 further show that the flexible circuit board 31 has a device portion 313 located on the front side of the annular portion 310, and the device portion 313 is used for installing an electronic device (not marked) and is used for electrically connect the receiver 21; and the flexible circuit board 31 has a chip portion 314 connected to the bottom end of the annular portion 310, and the chip portion 314 is used for binding the chip 22 of the hearing aid. At this time, the receiver 21, the chip 22 and the battery 32 can be stringed together by the flexible circuit board 31 into a compact structure, thereby ensuring their small size, and correspondingly enabling the size of the hearing aid to be also reduced.

It should be noted that the front side of the annular portion 310 where the device portion 313 is located is not directly in front of the annular portion 310, but there is a slight deviation of 5-30 degrees. This angle can refer to the included angle C1 in FIG. 8 or the complementary angle (not marked) of the central angle D2 in FIG. 12.

Referring to FIGS. 10 and 11, the flexible circuit board 31 further includes a first end plate 315 and a second end plate 316, wherein the first end plate 315 is used for fixing the microphone 41, and the second end plate 316 is used for fixing the switch 42.

Referring to FIGS. 10 and 11, a first connecting section 3151 is connected between the first end plate 315 and the annular portion 310, and a second connecting section 3161 is connected between the second end plate 316 and the annular portion 310. The first connecting section 3151 and the second connecting section 3161 intersect each other, and the intersection becomes an intersection position (not marked) of the annular portion 310. The first end plate 315 and the second end plate 316 expand in two directions from the intersection position. The bracket 43 clamps the intersection through an internal opening 430 thereof (referring to FIG. 1), so that the flexible circuit board 31 maintains a good bending shape as shown in FIGS. 10 and 11. Reference may be made to subsequent FIGS. 18 to 21 in combination with FIG. 4.

FIG. 12 shows that the annular portion 310 is divided into two sections by the device portion 313 and the intersection position. The outer side surface of each section has two pads 311, and each pad has a conductive contact sheet 33.

In order to meet the circuit requirements, the device portion 313 is also used for placing a plurality of electronic devices (not marked). For example, one electronic device may be a power field effect transistor, and the other may be a power supply voltage monitor.

Referring to FIG. 10, the first end plate 315 has a sound transmission hole 3150, and the second end plate 316 has two positioning holes 3160. The sound transmission hole 3150 is used for cooperating with the sound reception of the microphone 41, and the positioning holes 3160 are used for the installation of the switch 42.

The chip portion 314 is connected to the bottom end of the device portion 313, and there is a bent connecting portion 3131 there between referring to FIG. 11.

An included angle between the bottom of the chip portion 314 and the bottom surface of the annular portion 310 may be 150-175 degrees. In FIGS. 10 and 11, the included angle is shown by an angle D1, that is, the angle D1 is 150-175 degrees. Such a structure can ensure the fixation of various circuit structures on the flexible circuit board, and make the entire structure small in size, while also ensuring that the corresponding entire hearing aid structure is ergonomic.

The central angle of the device portion 313 and the intersection position at the annular portion 310 may be 160-179 degrees. In FIG. 12, the included angle is shown by a central angle D2, that is, the central angle D2 is 160-179 degrees. Such a structure makes the entire flexible circuit board 31 more stable and small in size, and also ensures that the structure of the hearing aid is more ergonomic.

It can be seen from the foregoing contents that this embodiment also provides a hearing aid electrical contact structure.

The hearing aid electrical contact structure includes: a housing 10, wherein the housing 10 includes a front section 11 and a rear section 12 connected to each other, and the housing 10 is divided into a first housing body 10A and a second housing body 10B, as shown in FIGS. 6 and 7; the rear section 12 is used for accommodating a battery 32 and at least a part of a flexible circuit board 31, as shown in FIG. 4; an outer side surface of the rear section 12 has at least two side holes, specifically the first rear section 12A has two first side holes A1, and the second rear section 12B has two second side holes Bl, as shown in FIGS. 6 and 7; a conductive contact sheet 33 is assembled in each of the first side holes A1 and the second side holes B 1, as shown in FIGS. 2 and 3; the conductive contact sheet 33 is electrically connected to a conductive pad 311 of the flexible circuit board 31, as shown in FIG. 4 and FIGS. 18 to 21; an outer surface of the conductive contact sheet 33 smoothly transitions with the outer side surface of the rear section 12, as shown in FIGS. 2 and 3.

Smooth transition means that the side holes are tightly cooperated with the conductive contact sheet 33, and there is basically no gap, and the outer side surface of the rear section 12 where the side holes are located is integrated with the outer surface of the conductive contact sheet 33. For example, the outer surface 331 of the conductive contact sheet 33 and the outer surface of the rear section 12 form a structure located on the same curved surface. At this time, the position of the conductive contact sheet 33 will neither form a groove structure nor a convex structure, thus preventing the groove structure or the convex structure from damaging the charging contact of a corresponding charging device (such as a charging box) during use, achieving the function of protecting the corresponding charging contact, and protecting the conductive contact sheet 33 and the side holes themselves.

In this embodiment, the first rear section 12A has two first side holes A1, and the second rear section 12B has two second side holes B 1. Therefore, there are four conductive contact sheets 33. The four conductive contact sheets 33 are used as a circuit positive electrode, a circuit negative electrode, a shutdown trigger electrode and a program burning interface, respectively. The design of the four conductive contact sheets can enhance the function of the hearing aid.

The design of the conductive contact sheet 33 as the shutdown trigger electrode enables the hearing aid to cooperate with the charging device (such as the charging box) to achieve intelligent shutdown. Specifically, when the specially designed electrical trigger contact in the charging device touches the conductive contact sheet 33 as the shutdown trigger electrode, the hearing aid will immediately shut down, thus avoiding the situation where the user forgets to shut down, and ensuring that the hearing aid will be triggered to shut down as soon as the hearing aid is placed on the charging device to achieve automatic shutdown and prevent waste of power.

The design of the conductive contact sheet 33 as the program burning interface enables the hearing aid to be further upgraded in the future, that is, new programs can be further burned, so that the programs of the hearing aid can iteratively update the version to meet more usage needs.

It should be noted that in other embodiments of the present disclosure, there may also be three conductive contact sheets, which are used as a circuit positive electrode, a circuit negative electrode and a shutdown trigger electrode, respectively; alternatively, there are three conductive contact sheets, which are used as a circuit positive electrode, a circuit negative electrode and a program burning interface, respectively.

Figure 13:
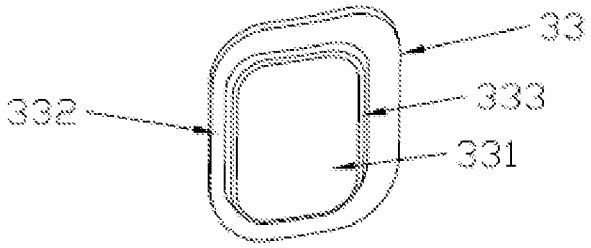
FIG. 13 is a schematic diagram of a conductive contact sheet from a first viewing angle.

Referring to FIG. 13, the conductive contact sheet 33 has a stepped double-layer structure with an outer surface 331 and an inner ring surface 332, and the side surface 333 connecting the inner ring surface 332 and the outer surface 331 is an inclined surface. That is to say, the side surface 333 is neither perpendicular to the outer surface 331, nor perpendicular to the inner ring surface 332, but respectively forms an obtuse angle therewith. On the one hand, the conductive contact sheet 33 with this structure can be more convenient to assemble, and on the other hand, it can be ensured that the above-mentioned smooth transition is better realized after assembly.

Figure 14:
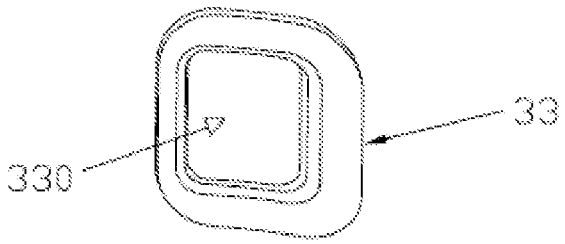
FIG. 14 is a schematic diagram of the conductive contact sheet with conductive foam removed from a second viewing angle.
Figure 15:
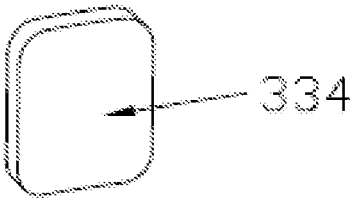
FIG. 15 is a schematic diagram of the conductive foam.
Figure 16:
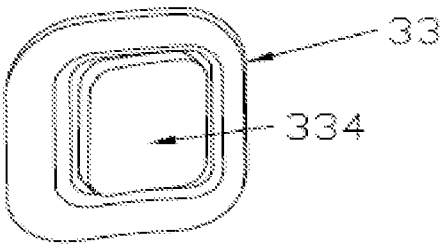
FIG. 16 is a schematic diagram from a third viewing angle when the conductive contact sheet is assembled with the conductive foam.

Referring to FIG. 14, a groove 330 is provided inside the inner side surface of the conductive contact sheet 33, a conductive foam 334 is provided in the groove 330 (not shown in FIG. 14, referring to FIG. 16). A separate conductive foam 334 is shown with reference to FIG. 15. The conductive foam 334 is adhered to an inner side surface of the groove 330, and referring to FIG. 16, specifically, the adhering may be implemented by using a double-sided conductive adhesive (not shown).

Figure 18:
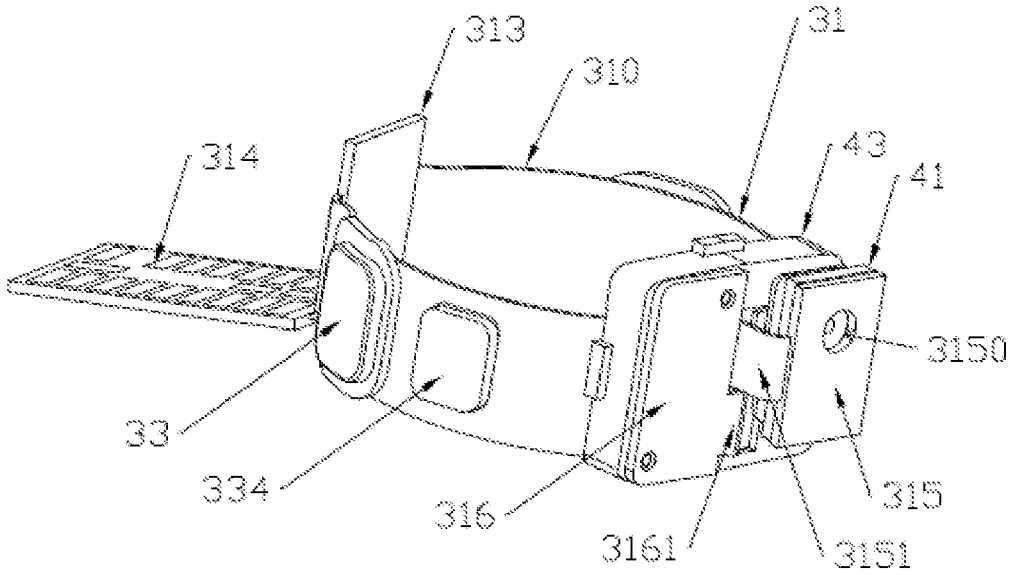
FIG. 18 is a schematic diagram of an assembly structure of a flexible circuit board, a bracket, a conductive contact sheet and a microphone.

Referring to FIG. 18, one of the conductive foams 334 is separately shown pressed on the corresponding pad 311, the pad 311 is just shielded by the conductive foam 334, so reference can be made back to FIGS. 1, 10 and 11. The design of the conductive foam 334 can improve the adhesion and the conductivity between the conductive contact sheet 33 and the pad 311, achieving the improvement of double effects.

The flexible circuit board 31 is integral, the annular portion 310 of the flexible circuit board 31 is divided into two sections by the device portion 313 and the intersection position, and an outer side surface of each section has two pads 311. The outer surfaces of the two conductive contact sheets 33 smoothly transition with the side holes of the first rear section 12A, and the outer surfaces of the two conductive contact sheets 33 smoothly transition with the side holes of the second rear section 12B.

Figure 17:
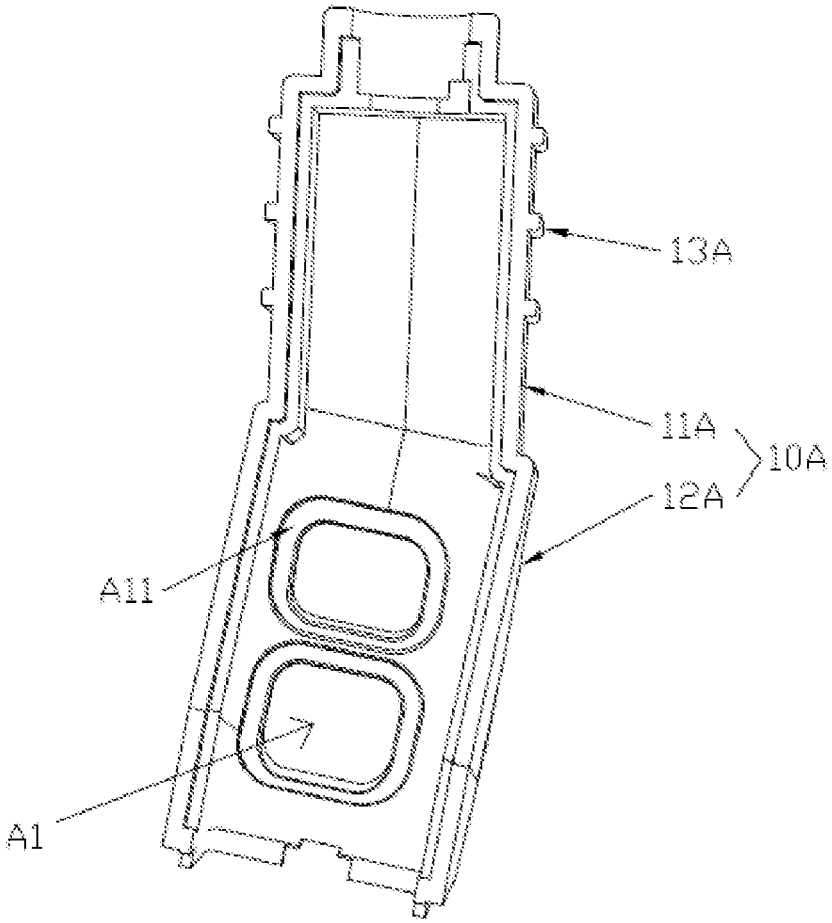
FIG. 17 is a schematic diagram of an inner side surface of a first housing body.

FIG. 17 shows the structure of the inner side surface of the first housing body 10A. It can be seen that the inner side of the edge of the first side hole A1 has a side groove A11 that matches the side surface 333 of the above-mentioned conductive contact sheet 33. Specifically, the side surface 333 and the side groove A11 may be bonded and cooperated by glue, that is, the conductive contact sheet 33 is fixed to the first housing body 10A, and then press-fitted and fixed to the pad. The cooperation of the side surface 333 and the side groove A11 not only facilitates the assembly of the conductive contact sheet 33 with the first housing body 10A, but also further ensures that after the assembly, the outer surface 331 of the conductive contact sheet 33 smoothly transitions with the first rear section 12A of the first housing body 10A.

Similarly, the second housing body 10B also has a corresponding structure, so that the outer surface 331 of the conductive contact sheet 33 realizes smooth transition with the second rear section 12B of the second housing body 10B, which will not be repeated.

It can be seen from the foregoing contents that this embodiment also provides a hearing aid microphone structure.

Figure 19:
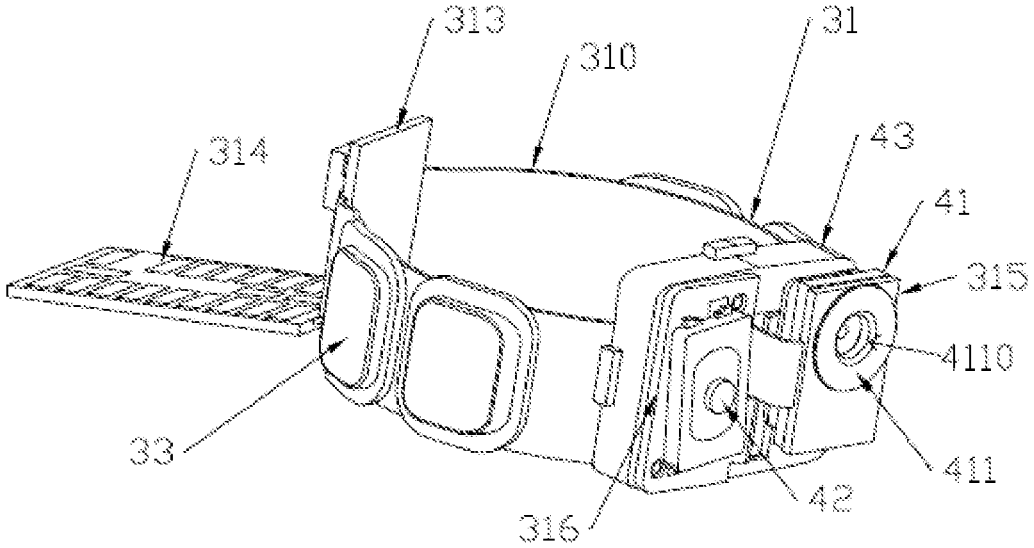
FIG. 19 is a schematic structural diagram of the structure of FIG. 18 continuing to be assembled with sound-guiding foam and a switch.
Figure 20:
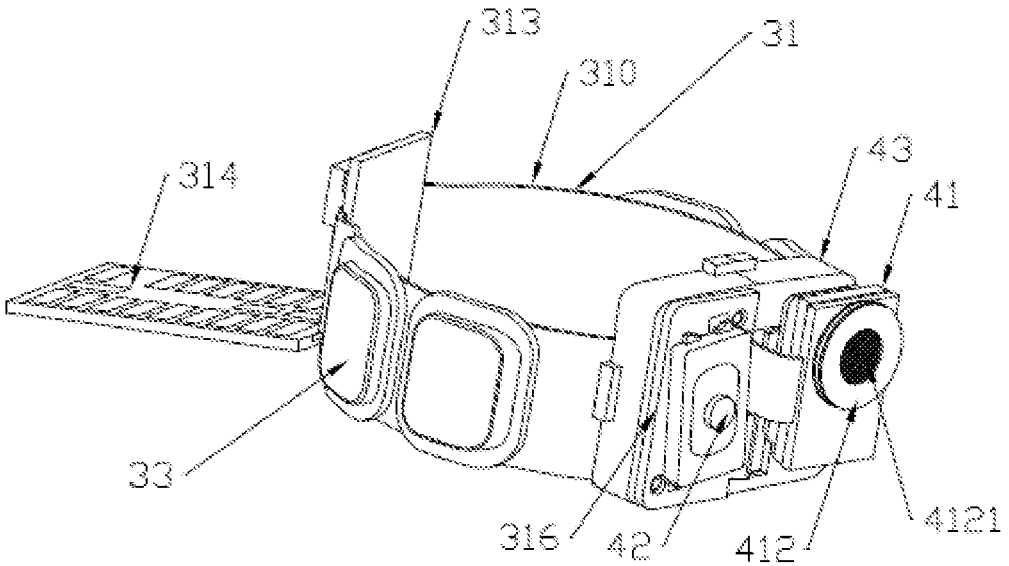
FIG. 20 is a schematic structural diagram of the structure of FIG. 19 continuing to be assembled with a dust-proof net.

The hearing aid microphone structure includes: a microphone 41 arranged on the front surface of the first end plate 315 in the housing 10, wherein the first end plate 315 is a part of the flexible circuit board 31, and the first end plate 315 has a sound transmission hole 3150, as shown in FIG. 18; a sound-guiding foam 411 arranged on the rear surface of the first end plate 315, wherein the sound-guiding foam 411 has a sound-guiding hole 4110, and the sound-guiding hole 4110 is communicated with the sound transmission hole 3150, as shown in FIGS. 18 and 19; and a dust-proof net 412 arranged on the sound-conducting foam 411, wherein the dust-proof net 412 has a peripheral portion (not distinctively marked) and a net portion 4121, and the net portion 4121 is blocked in front of the sound-guiding hole 4110, as shown in FIG. 20.

As described above, the hearing aid microphone structure further includes a bracket 43, wherein the bracket 43 uses its opening 430 (referring to FIG. 1) to hold the first connecting section 3151 and the second connecting section 3161 together, referring to FIG. 18. At the same time, the bracket 43 fixes the first end plate 315 and the second end plate 316 on the bracket 43 together.

Figure 21:
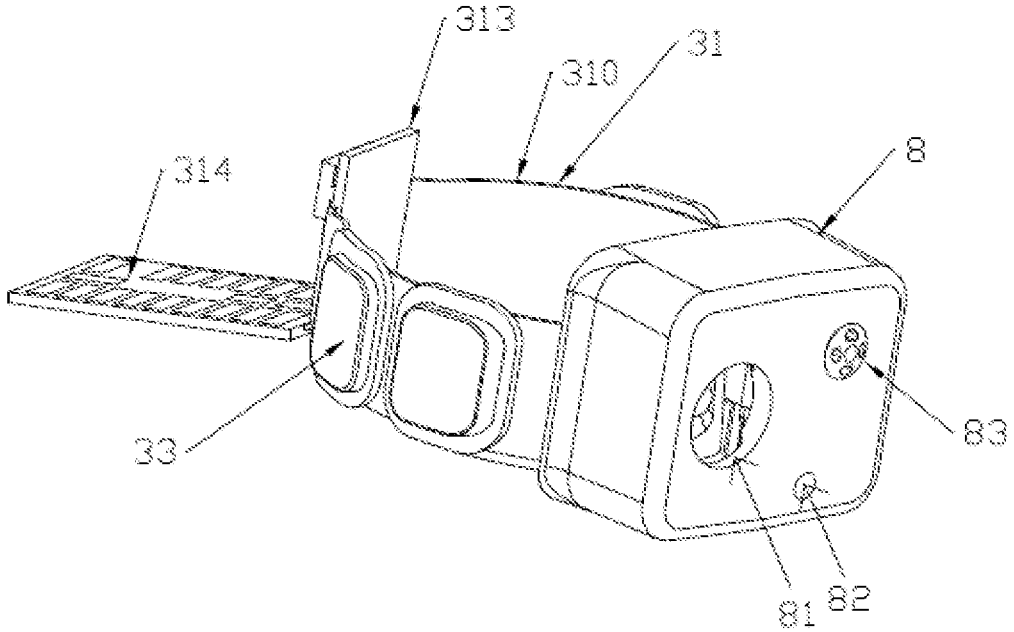
FIG. 21 is a schematic structural diagram of the structure of FIG. 20 continuing to be assembled with a rear cover.

As described above, referring to FIGS. 18 to 21, the rear cover 8 is assembled with the bracket 43; the microphone 41, the sound-guiding foam 411 and the dust-proof net 412 are located between the rear cover 8 and the bracket 43; at the same time, the first end plate 315 and the second end plate 316 are also located between the rear cover 8 and the bracket 43 (inside), wherein the first connecting section 3151 and the second connecting section 3161 pass through the opening 430 of the bracket 43. At the same time, a switch 42 is provided on the second end plate 316, and the switch 42 is located between the rear cover 8 and the bracket 43. The switch 42 and the microphone 41 are protected by the rear cover 8 inside. FIG. 21 shows only the structure of the rear cover 8 after assembly, and the assembly of the take-out line 9 and the button 421 is omitted. At this time, in the overall structure of the hearing aid, it is ensured that the microphone 41 is at the rear for better capture of external sounds, and the receiver 21 is at the front to ensure that the user can hear sounds as loud as possible, and at the same time, the entire structure is more stable.

Although embodiments of the present disclosure have been shown and described, those of ordinary skill in the art may make variations, modifications, substitutions and alterations to the above embodiments within the scope of the present disclosure, which is defined by the appended claims.

What is claimed is:

1. A completely-in-canal hearing aid, comprising
a housing,
a receiver,
a chip,
a battery,
a flexible circuit board and
a microphone,
wherein:
the housing comprises a front section and a rear section;
the receiver and the chip are located in the front section;
the battery is located in the rear section;
the rear section has two opposite surfaces and two opposite side surfaces;
the front section has a first central axis parallel to a length of the front section;
the rear section has a second central axis located between the two opposite surfaces and between the two opposite side surfaces;
the first central axis and the second central axis are different straight lines;
the two opposite surfaces of the rear section are planes;
the housing is divided into a first housing body and a second housing body,
wherein the first housing body has a first opposite side surface and the second housing body has a second opposite side surface, the first opposite side surface of the first housing body is a first side surface, the second opposite side surface of the second housing body is a second side surface, the first side surface is a first part of a cylindrical side surface, and the second side surface is a second part of the cylindrical side surface;
the first housing body comprises a first front section and a first rear section connected to each other;
the second housing body comprises a second front section and a second rear section connected to each other;
the receiver and the chip are located in the first front section and the second front section; and
the battery is located in the first rear section and the second rear section.

2. The completely-in-canal hearing aid according to claim 1, wherein the battery is a button battery; the flexible circuit board has an annular portion bent into an annular shape, and the annular portion surrounds a peripheral side of the battery.

3. The completely-in-canal hearing aid according to claim 2, wherein
the front section has a front opening;
the rear section has a rear opening;
a plane bisecting a width of the front section and bisecting the front opening is a first plane;
a plane bisecting a width of the rear section and bisecting the rear opening is a second plane; and
an included angle between the first plane and the second plane is 5-30 degrees.

4. The completely-in-canal hearing aid according to claim 3, wherein
a plane bisecting a thickness of the front section is a third plane;
a plane bisecting a thickness of the rear section is a fourth plane; and
an included angle between the third plane and the fourth plane is 1-20 degrees.

5. The completely-in-canal hearing aid according to claim 2, wherein an outer side surface of the first rear section and an outer side surface of the second rear section respectively have side holes, and a conductive contact sheet is assembled in each of the side holes; and the conductive contact sheet is electrically connected to a pad on an outer side surface of the flexible circuit board.

6. The completely-in-canal hearing aid according to claim 3, further comprising an earplug and a front cover, wherein the front cover is arranged at front ends of the first front section and the second front section; and the earplug is assembled at the front ends of the first front section and the second front section through the front cover.

7. The completely-in-canal hearing aid according to claim 6, wherein an outer surface of the first front section has a first outer convex edge, and an outer surface of the second front section has a second outer convex edge.

8. The completely-in-canal hearing aid according to claim 7, further comprising a cerumen cap, wherein the cerumen cap is installed between the front cover and the front ends of both the first front section and the second front section.

9. The completely-in-canal hearing aid according to claim 6, further comprising a switch, a bracket, a button, a rear cover and a take-out line, wherein the bracket fixes the switch and the microphone; a first end of the button is exposed outside the rear cover, and a second end of the button is pressed against the switch; and the take-out line is installed at the rear cover.

* * * * *